US010237643B2

(12) United States Patent
Janevics

(10) Patent No.: US 10,237,643 B2
(45) Date of Patent: Mar. 19, 2019

(54) LOUDSPEAKER

(71) Applicant: Eugeny Boguslavskiy, Jurmala (LV)

(72) Inventor: Rolands Janevics, Kraslava (LV)

(73) Assignee: Eugeny Boguslavskiy, Jurmala (LV)

( * ) Notice: Subject to any disclaimer, the term of this patent is extended or adjusted under 35 U.S.C. 154(b) by 0 days.

(21) Appl. No.: 15/571,882

(22) PCT Filed: May 12, 2016

(86) PCT No.: PCT/IB2016/052746

§ 371 (c)(1),
(2) Date: Nov. 6, 2017

(87) PCT Pub. No.: WO2016/181346

PCT Pub. Date: Nov. 17, 2016

(65) Prior Publication Data

US 2018/0124500 A1 May 3, 2018

(30) Foreign Application Priority Data

May 14, 2015 (RU) ..... 2015118053

(51) Int. Cl.

| | |
|---|---|
| ***H04R 1/30*** | (2006.01) |
| ***H04R 1/24*** | (2006.01) |
| ***H04R 19/02*** | (2006.01) |
| ***H04R 1/28*** | (2006.01) |
| ***H04R 3/14*** | (2006.01) |

(52) U.S. Cl.

CPC ..... *H04R 1/24* (2013.01); *H04R 1/2811* (2013.01); *H04R 3/14* (2013.01); *H04R 19/02* (2013.01)

(58) Field of Classification Search

CPC ..... H04R 1/00; H04R 2205/022; H04R 2201/401; H04R 2201/405; H04R 1/28; H04R 1/2807

USPC ..... 381/182, 337–342

See application file for complete search history.

(56) References Cited

U.S. PATENT DOCUMENTS 3,931,867 A * 1/1976 Janszen ..... H04R 1/24 181/155
4,191,863 A * 3/1980 Matsuda ..... H04R 9/063 381/182
4,227,051 A * 10/1980 Thomas ..... H04R 1/24 181/144

(Continued)

FOREIGN PATENT DOCUMENTS

EP 2701401 A3 8/2015

*Primary Examiner* — Suhan Ni
(74) *Attorney, Agent, or Firm* — Smartpat PLC

(57) ABSTRACT

A loudspeaker comprising at least three first emitting heads (11) adapted to emit in a first frequency range, and at least one second emitting head (13) adapted to emit in a second frequency range, the first emitting heads (11) are located in close proximity to each other in the vertices of a virtual regular polygon with the number of vertices equal to the number of first emitting heads (11), and the second emitting head (13) is located in proximity to the geometric center of said virtual polygon, wherein the first emitting heads have conical diaphragms (14), oriented with their convex side in the direction of the listener, and the emission axes of the first emission heads are inclined at an angle (α) to a perpendicular drawn through the center of the polygon, where the angle (α) is in a range of from 5 to 25 degrees.

7 Claims, 8 Drawing Sheets

(56) References Cited

U.S. PATENT DOCUMENTS

| | | | | |
|---|---|---|---|---|
| 4,243,840 | A | 1/1981 | Kates | |
| 4,252,211 | A * | 2/1981 | Matsuda | H04R 1/22 181/166 |
| 4,885,782 | A | 12/1989 | Eberbach | |
| 4,984,278 | A * | 1/1991 | Frye | H04R 1/30 248/179.1 |
| 6,009,972 | A | 1/2000 | Choi et al. | |
| 8,175,304 | B1 * | 5/2012 | North | H04R 1/403 381/17 |
| 8,194,904 | B2 * | 6/2012 | Iwayama | H04R 1/345 181/144 |
| 2002/0191807 | A1 | 12/2002 | Asada et al. | |
| 2008/0044044 | A1 | 2/2008 | Madaffari et al. | |
| 2012/0269368 | A1 | 10/2012 | Horbach | |

* cited by examiner

LOUDSPEAKER

TECHNICAL FIELD

The invention relates to the field of sound reproducing devices, and more particularly to loudspeakers.

BACKGROUND

It is known to use loudspeakers comprising a plurality of emitting heads, each of which is designed to reproduce sound in a certain frequency range, for example, an AC-35 loudspeaker produced by (p/o Radiotekhnika), which used three emitting heads, one for low frequencies, one for medium and one for high. The disadvantage of such loudspeakers is low sensitivity, large phase distortion and uneven angular acoustic power.

The device described in U.S. Pat. No. 6,801,631 (DONALD J. NORTH) is known, which uses four low-frequency emitting heads located at the corners of a square and an additional head of a higher frequency range located between them.

The disadvantage of such a loudspeaker is the uneven angular acoustic power at the crossover frequency.

The closest to the proposed technical solution is the device disclosed in the description of the patent for invention U.S. Pat. No. 4,885,782 A (KRAUSSE HOWARD). The device comprises at least one high-frequency emitting head and several low-frequency heads located in one plane symmetrically relative to the high-frequency head.

The disadvantage of such a loudspeaker is the uneven angular acoustic power at the crossover frequency.

One object of the invention is to reduce the unevenness of the angular acoustic power characteristic and to improve the sound quality of the loudspeaker.

Other objects of the invention are to reduce the number of loudspeaker bands, to reduce phase distortion, to reduce the longitudinal and lateral resonances of the loudspeaker housing, to increase the volume displacement of the loudspeaker, to increase the sensitivity and acoustic power of the loudspeaker.

SUMMARY

The technical result is achieved in a loudspeaker comprising at least three first emitting heads configured to emit in the first frequency range, and at least one second emitting head configured to emit in the second frequency range, the first emitting heads are disposed in proximity to each other, at the vertices of a virtual regular polygon with the number of angles equal to the number of the first emitting heads, and the second emitting head is located in proximity to the geometric center of said virtual polygon. The first emitting heads have conical diaphragms oriented with their convex side or a tapering end towards the listener, and the emission axes of the first emitting heads are inclined at an angle ($\alpha$) to the perpendicular drawn through the center of said polygon, where the angle ($\alpha$) is in the range of 5 to 25 degrees.

Such an arrangement of low-frequency emitting heads, firstly, allows bringing their acoustic centers closer to each other. Approximation of the acoustic centers of the emitting heads makes it possible to increase the crossover frequency, to reduce distortions of the angular power and to increase the acoustic load on the diaphragm. Increasing the acoustic load on the diaphragm leads to suppression of high-frequency components of the signal, which makes it possible to use filters of the first order in the frequency division of the signal, which, in turn, reduces the phase distortions introduced by the filters. Secondly, this arrangement of the emitting heads approximates the loudspeaker emission to the emission of the point source, which contributes to the uniformity of the characteristics in all directions.

It is desirable that the number of the first emitting heads be three or, more advantageously, four. With such a number of emitting heads, their acoustic centers are close enough to each other so that the loudspeaker emission is close to the emission of the point source, which improves the uniformity of the spatial characteristics of the emission.

Preferably, the emission axes of the first emitting heads are directed to one point. This improves the concentration of sound waves and reduces signal distortion.

It is convenient to use in the loudspeaker heads with a round aperture as the first emitting heads.

Preferably, the upper limit of the first frequency range does not exceed 1000 Hz. And the lower limit of the second frequency range is selected from 400 Hz and higher. With such frequency ranges, the interface between the frequency ranges is between 400 and 800 Hz and minimally affects the hearing.

DETAILED DESCRIPTION

Figure 1:
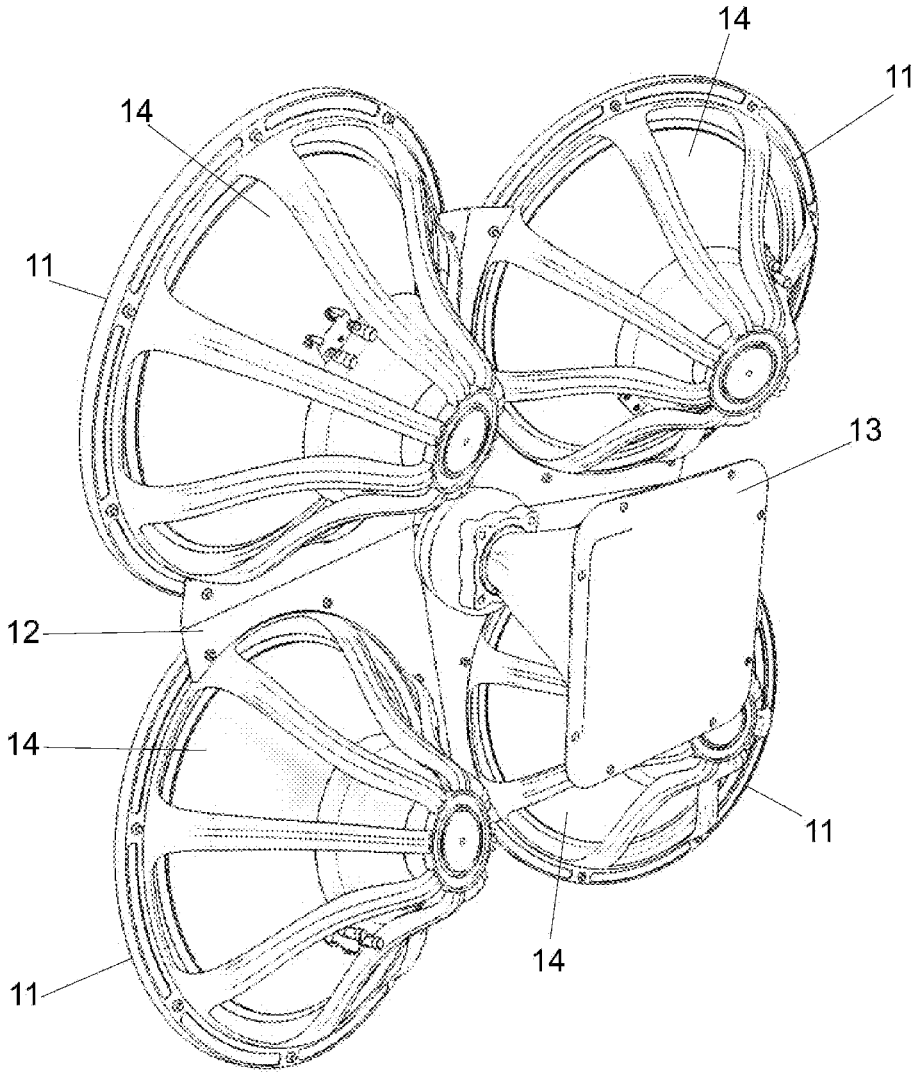
FIG. 1 shows a general view of the loudspeaker.
Figure 2:
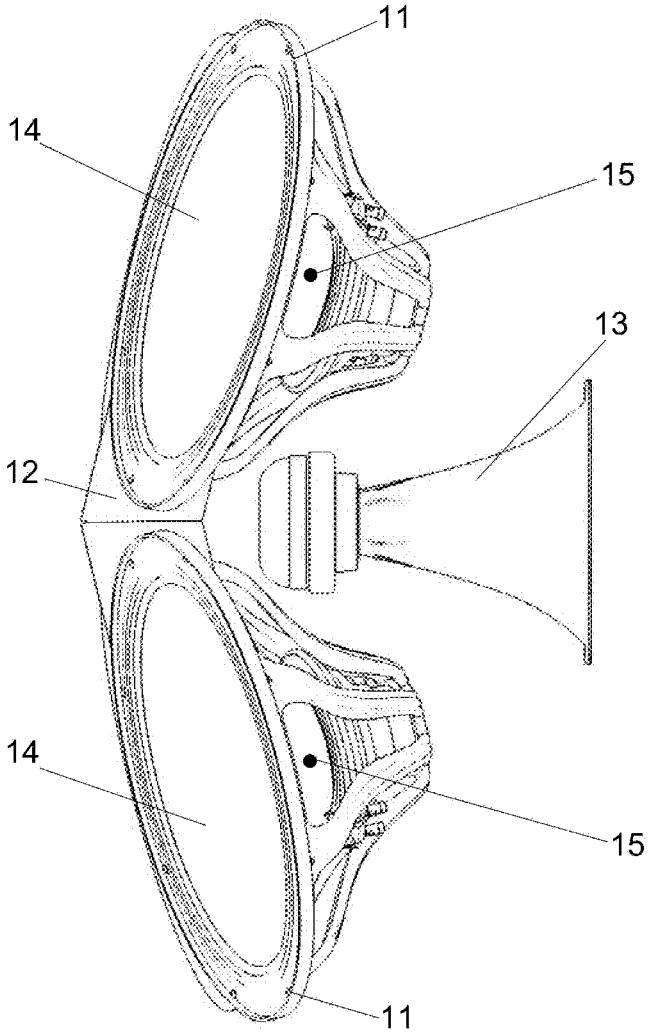
FIG. 2 shows a side view of the loudspeaker.
Figure 3:
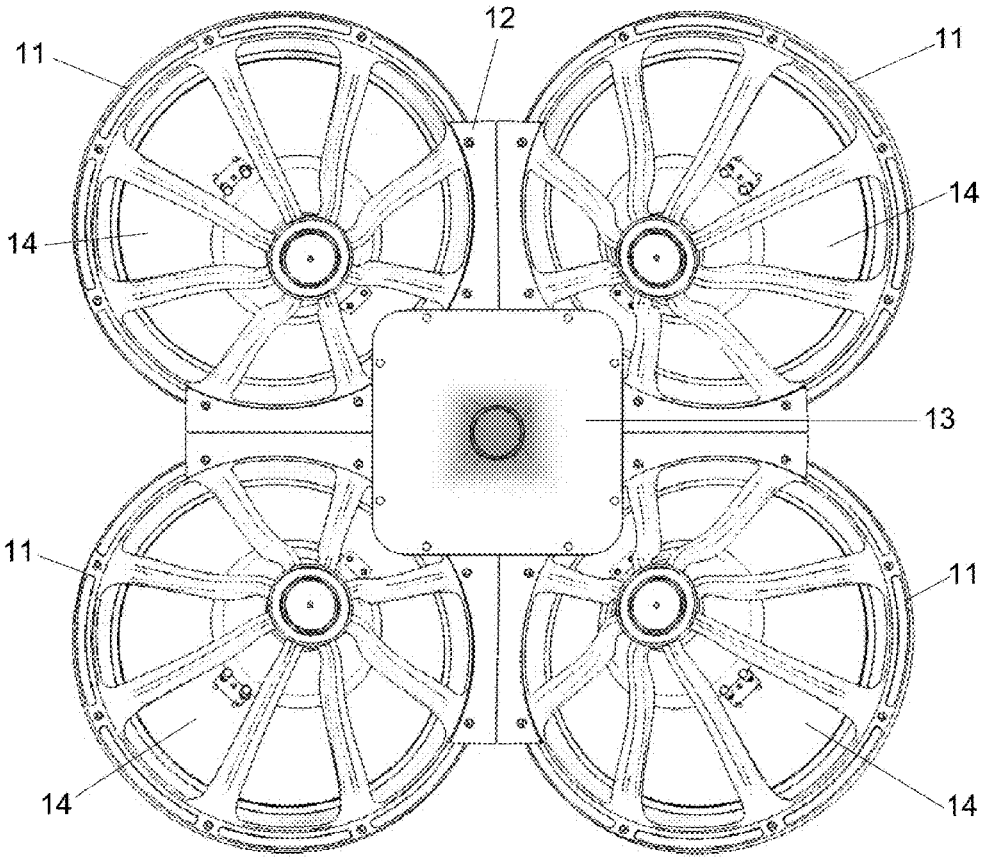
FIG. 3 shows a front view of the loudspeaker.

The loudspeaker shown in FIG. 1-3 contains four low-frequency emitting heads (11) with a diameter of 46 cm. The emitting heads are mounted on a rigid frame (12) close to each other and inclined at an angle of 12 degrees to the center of the loudspeaker. In the space between low-frequency emitting heads (11), a broadband emitting head (13) is installed. Low-frequency emitting heads (11) have conical diaphragms (14), oriented with a convex side in the direction of the listener. Thus, the loudspeaker is an acoustic directional system.

The loudspeaker uses low-frequency emitting heads with conical diaphragms. In such emitting heads, the acoustic center (15) or the center of the emission, as a rule, is located inside the cone of the diaphragm, near its narrow part, often at a considerable distance from the aperture of the diaphragm—the wide open end of the cone. In the traditional arrangement of the emitting heads with their aperture to the listener, the acoustic center (15) is located behind the aperture. Therefore, when the emitting heads are tilted so that their emission axes are directed at the listener, the distance between their acoustic centers (15) increases. However, for better performance of the loudspeaker, it is desirable that the distance between the acoustic centers (15) of adjacent emitting heads, indicated in the drawings by the letter A, be as small as possible. In the traditional loudspeaker, this distance cannot be less than the diameter of the emitting head, indicated in the drawings by the letter D. In the proposed loudspeaker, the distance A, is less, since when the emitting heads are tilted to the center of the loudspeaker, their acoustic centers (15) approach each other.

The pressure level at low frequencies, below 40 Hz, also depends on the diameter of the diaphragm. In this loudspeaker, it is advisable to use emitting heads with a diameter of 16 cm or more.

Such an arrangement of the low-frequency emitting heads (11) makes it possible to bring their acoustic centers (15) closer to each other. Approximation of the acoustic centers of the emitting heads (11) makes it possible to increase the crossover frequency and to reduce the distortion of the angular power and increase the acoustic load on the diaphragm. Increasing the acoustic load on the diaphragm leads to suppression of high-frequency components of the signal, which makes it possible to use first-order filters in the crossover, which in turn reduces the phase distortions introduced by the filters.

The proposed loudspeaker works as follows. The reproduced signal passes through an active crossover with a separation frequency of 500 Hz, is then amplified and fed to the respective emitting heads.

Figure 4:
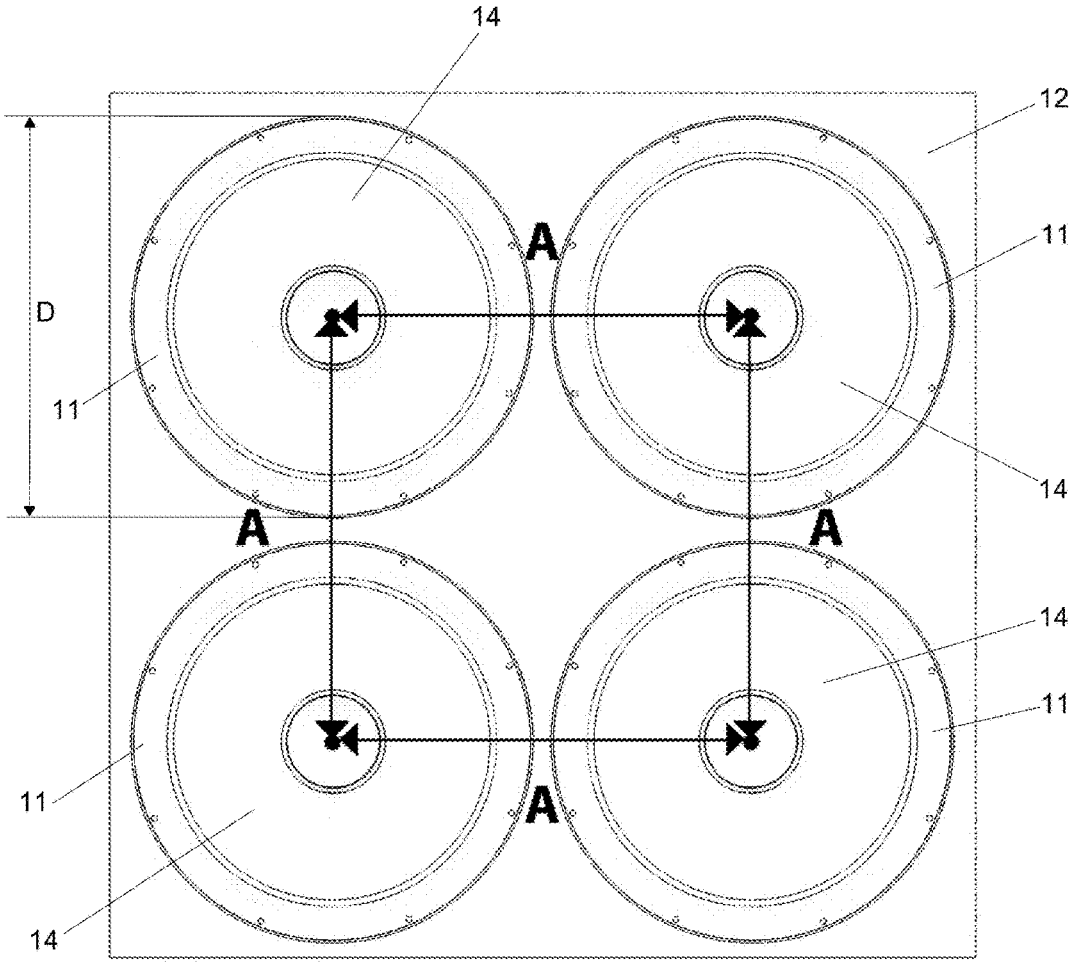
(PRIOR ART) Fig. 4
FIG. 4 shows a schematic representation of a traditional loudspeaker.
Figure 5:
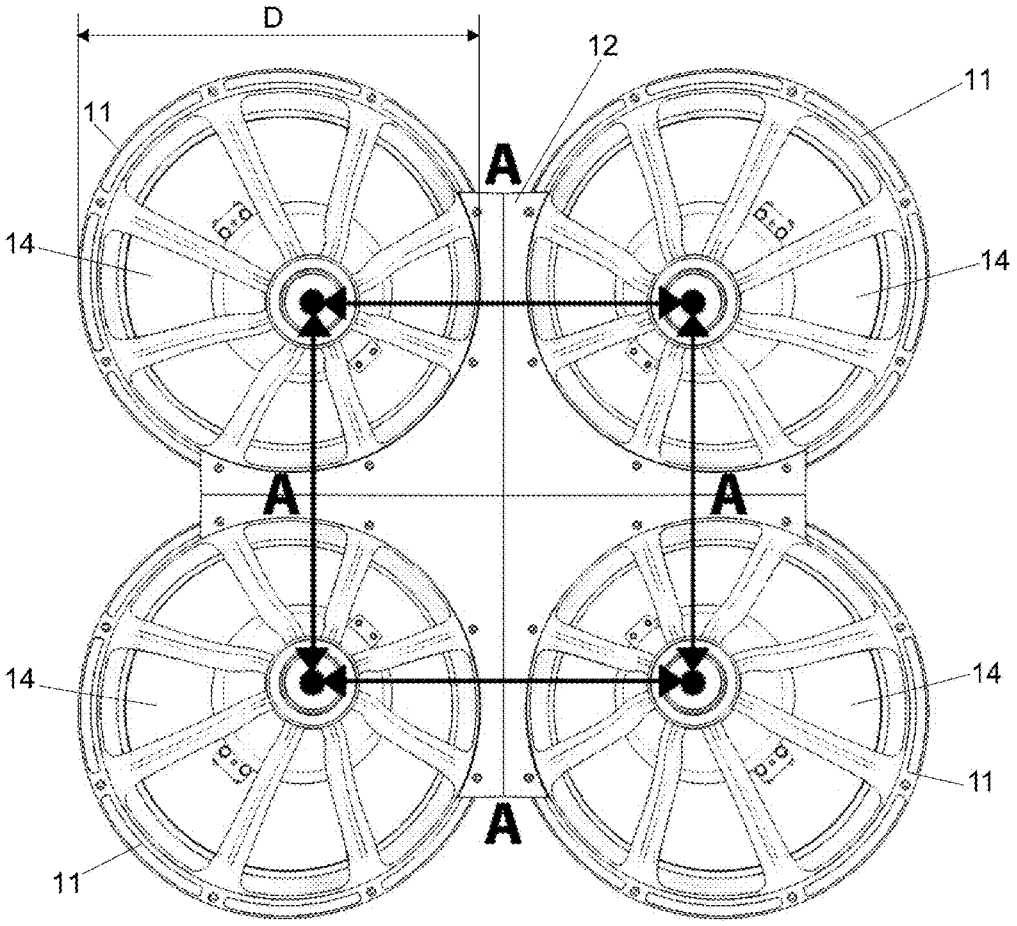
FIG. 5 shows a schematic representation of the proposed loudspeaker.

For comparison, two loudspeakers were made from four identical low-frequency emitting heads with a diameter of 46 cm and without high-frequency emitting heads. One loudspeaker of a traditional design and the other in accordance with the present invention. In FIG. 5 is shown a schematic representation of the proposed loudspeaker without a high-frequency emitting head, and FIG. 4 schematically shows a conventional construction comprising the same four low-frequency emitting heads mounted in one plane without tilting to the center. In this case, the minimum possible distance between the acoustic centers of the heads, indicated by the letter A in the figure, is equal to the diameter of the emitting head.

Figure 6:
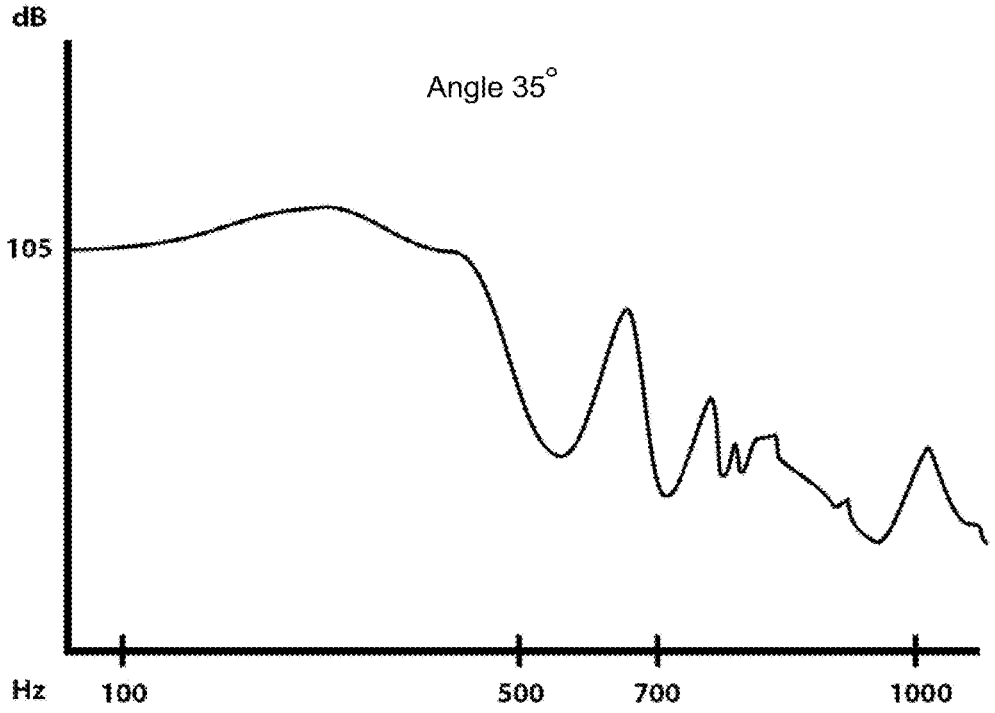
FIG. 6 shows the frequency response of a traditional loudspeaker.
Figure 7:
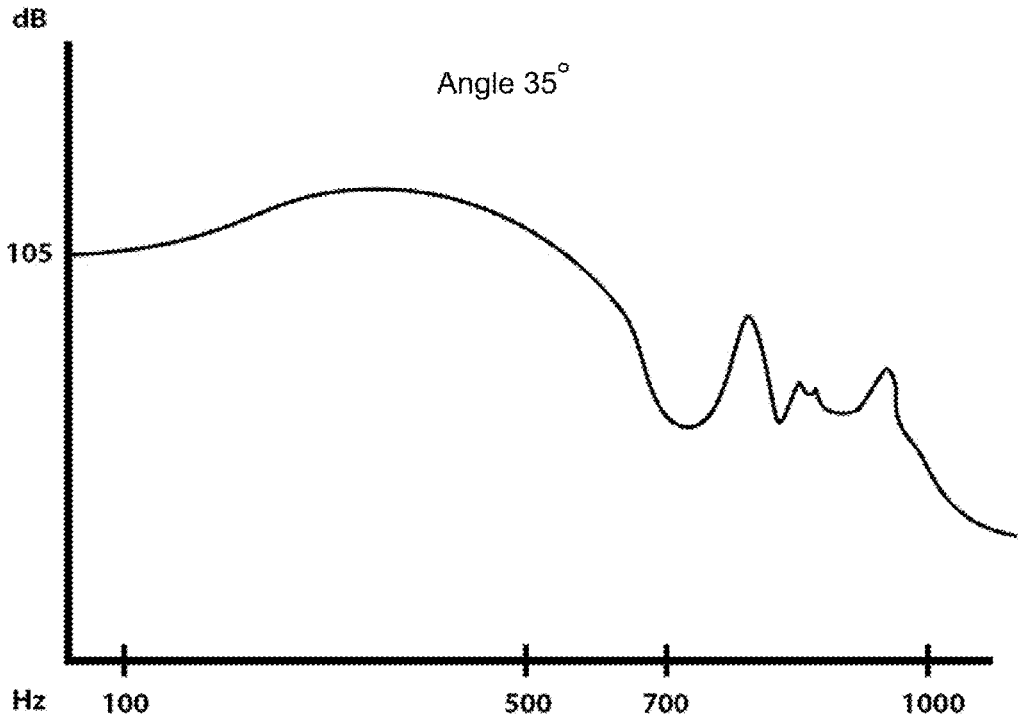
FIG. 7 shows the frequency response of the proposed loudspeaker.

In FIGS. 6 and 7 are shown the FRF (frequency response function) measured at an angle of 35 degrees to the axis of the loudspeaker at a distance of 2 meters from its center. As can be seen from the given graphs, the frequency response of the proposed loudspeaker is more uniform at the top of the range. Increasing the uniformity of the frequency response reduces the number of loudspeaker bands and contributes to a more smooth matching of the frequency ranges of the emitting heads.

A more even angular FRF characteristic makes it possible to use large-sized emitting heads in this design, which makes it possible to increase the volume displacement of the entire loudspeaker, its sensitivity and acoustic power.

The proposed arrangement of the emitting heads approximates the emission of the loudspeaker to the emission from the point source, which contributes to the uniformity of the characteristics in all directions.

The absence of a housing and parallel planes minimizes the occurrence of resonant frequencies associated with the dimensions of the loudspeaker housing.

Figure 8:
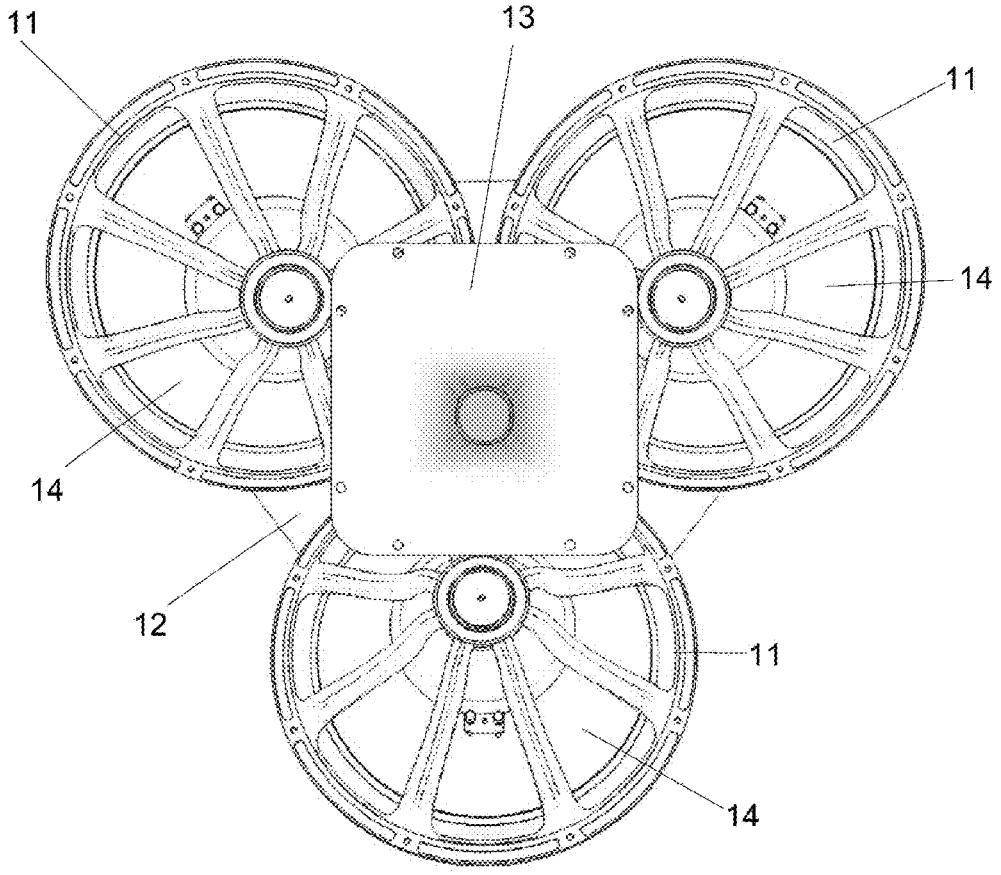
FIG. 8 shows another embodiment of the loudspeaker.

An embodiment of a loudspeaker with three low-frequency emitting heads, shown in FIG. 8, differs from the loudspeaker shown in FIG. 1-3, only by the number of low-frequency heads. In the loudspeaker with three emitting heads, the acoustic centers of the emitting heads are closer to each other than in the loudspeaker with four emitting heads, which improves the spatial characteristics of the loudspeaker, but its emission power at low frequencies is slightly reduced.

The invention can be used both for sound reproduction at home and for sound studios.

The invention claimed is:

1. A loudspeaker comprising a number at least three first emitting heads adapted to emit in a first frequency range, and at least one second emitting head adapted to emit in a second frequency range, wherein the first emitting heads are located in close proximity to each other at vertices of a virtual regular polygon with a number of vertices equal to the number of the first emitting heads, each of the first emitting heads having an emission axis which extends rearwardly from a tapered rear end of a conical diaphragm towards a front of the loudspeaker, and wherein the second emitting head is located in proximity to the geometric center of said virtual polygon and has an emission axis directed towards the front of the loudspeaker, and wherein the emission axes of the first emitting heads are inclined at an angle ($\alpha$) to the perpendicular drawn through the center of said polygon.

2. The loudspeaker of claim 1, wherein the number of the first emitting heads is four.

3. The loudspeaker of claim 1, wherein the emission axes of the first emitting heads are directed to a single point in space in front of the loudspeaker.

4. The loudspeaker of claim 1, wherein the first emitting heads have a circular aperture.

5. The loudspeaker of claim 1, wherein the first frequency range is up to 1000 Hz.

6. The loudspeaker of claim 1, wherein the second frequency range is from 400 Hz and higher.

7. The loudspeaker of claim 1, wherein the angle ($\alpha$) is between 5 and 25 degrees.

* * * * *